United States Patent [19]

Guery et al.

[11] Patent Number: 4,635,016

[45] Date of Patent: Jan. 6, 1987

[54] POLARIZED ELECTROMAGNET WITH BI OR MONOSTABLE OPERATION

[75] Inventors: Jean-Pierre Guery, Bezons; Jacques Olifant, Nanterre, both of France

[73] Assignee: La Telemecanique Electrique, France

[21] Appl. No.: 767,221

[22] Filed: Aug. 19, 1985

[30] Foreign Application Priority Data

Aug. 20, 1984 [FR] France ..... 84 12974

[51] Int. Cl.[4] ..... H01F 7/08

[52] U.S. Cl. ..... 335/230; 335/234

[58] Field of Search ..... 335/78, 79, 80, 81, 335/229, 230, 234

[56] References Cited

U.S. PATENT DOCUMENTS 2,915,681 12/1959 Troy ..... 335/229 X 4,451,808 5/1984 Koehler ..... 335/81 X

FOREIGN PATENT DOCUMENTS 148411 3/1983 Japan ..... 335/230

*Primary Examiner*—George Harris

*Attorney, Agent, or Firm*—William A. Drucker

[57] ABSTRACT

A polarized electromagnet with bi or monostable operation is provided in which two flux channelling pieces of rectangular shape are disposed one in the other and are magnetically associated by means of permanent magnets, whose axes, parallel to that of the coil, pass substantially through the carcase of said coil, inside which slides a core provided with two plates when the operation is to be bistable.

13 Claims, 9 Drawing Figures

POLARIZED ELECTROMAGNET WITH BI OR MONOSTABLE OPERATION

BACKGROUND OF THE INVENTION

1. Field of the Invention

The invention relates to a polarized electromagnet comprising:

a coil adapted to be fed with DC current, a magnetizable core which is movable between two longitudinal end positions occupied alternately by sliding inside the carcase of this coil, and which has two opposite external widened pole portions extending transversely with respect to the axis of the coil, a fixed yoke having axially, on each side of each widened pole portion, a pair of pole extensions having opposite magnetic polarities which are conferred thereon by permanent magnetic means placed therebetween and orientated so that their magnetic axes are parallel to said axis, said widened pole portions cooperating with said extensions so that, for each of the two end positions, the magnetic flux sent by said magnetic means through the core is of opposite direction.

2. Description of the Prior Art

Such electromagnets have a great interest for actuating relay or contactor switches where a good sensitivity and/or current economy are desirable.

An electromagnet having the above defined structure is known for example from French Patent No. 1 603 300 where it is applied to a polarized relay used for switching small currents.

In such a polarized relay, the use of a permanent magnet of annular shape and that of a cylindrical core, with the ends of which are concentrically associated two parallel disks, provides a symmetry of the magnetic attractions and repulsions which reacts at the same time on the sliding of the core inside the coil; such a relay has however the drawback of requiring the use of two permanent magnets for magnetizing the three separate pieces forming therewith the fixed yoke of the relay. In addition, the lateral and totally offcentered location of the magnets which gives to the assembly a flat shape of small thickness, defines proportions which it is difficult to use in some applications. In this known relay, the use of the two magnets and of the three pieces was made necessary because these pieces play a secondary role which is that of participating with the core in forming a switch for low current; for this, the permanent magnets require insulating ceramics for forming a galvanic insulation between the three pieces.

The invention proposes making improvements to this known relay for simplifying its structure when the core is associated directly or indirectly with a separate switch requiring, for switching thereof, the use of a higher force, while keeping the advantages from which it may benefit relatively to the generation of pulling forces perfectly concentric with the coil.

SUMMARY OF THE INVENTION

According to the invention, this aim is achieved, by the fact that two pairs of extensions, of the same first sign, placed symmetrically with respect to the axis of the coil form part of a first rectangular flux channelling piece surrounding a second flux channelling piece which connects together two other pairs of symmetrical extensions having signs opposite the first and which surround a coil whose carcase is substantially traversed by the magnetic axes of permanent magnets disposed at the same axial level between transverse flux channelling branches.

BRIEF DESCRIPTION OF THE DRAWINGS

Other features of the invention aimed at obtaining a monostable operation and respectively an apparatus easy to mount, as well as variants, will be better understood from reading the following description with reference to the accompanying drawings in which.

DESCRIPTION OF THE PREFERRED EMBODIMENTS

Figure 1:
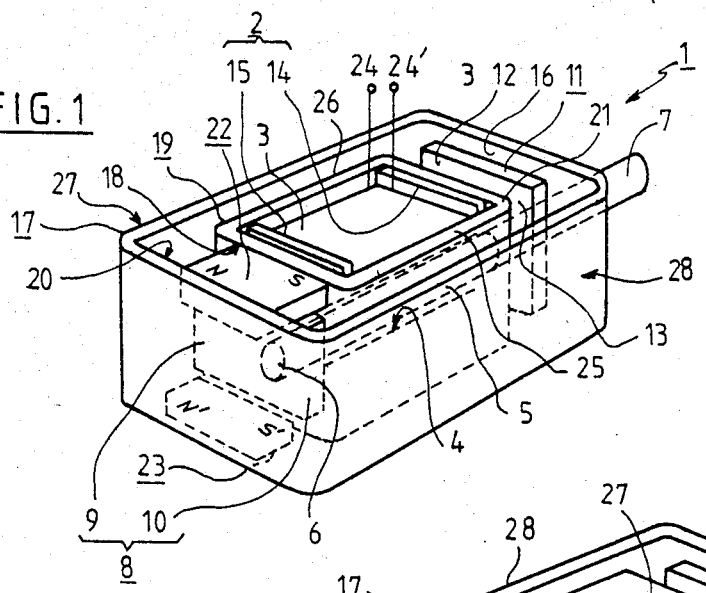
FIGS. 1 and 2 show in perspective two electromagnets according to the invention, only differing from each other by the relative arrangements of the two flux channelling pieces.

Since positions of elements of the electromagnet 1 shown in FIG. 1 are defined with respect to an axis of symmetry, this latter has been represented by XX' which also forms the longitudinal axis of the internal housing 4 of a carcase 2 receiving a coil 3; between two opposite end positions in this housing slides a magnetizable core 5 whose two ends 6 and 7 are partially visible in the Figure; end 6, which projects from cheek 15 of the carcase receives a first magnetizable plate 8 having two external symmetric transverse widened pole portions 9, 10, whereas a second magnetizable plate 11, having two external and symmetrical transverse widened pole portions 12, 13, is placed on the core between a cheek 14 of carcase 2 and end 7, this latter being for example used for controlling a switch not shown; the apparatus would not be changed if core 5, instead of stopping at the level of the second plate, were extended by an extension for providing a mechanical control. The core and its two plates form the mobile piece of the electromagnet and it is clear that the distance separating the two plates allows longitudinal movement thereof between the two opposite end positions.

In one of the end positions, plate 11 rests on a transverse external branch 16 belonging to a first flux channelling piece 17 in the form of a rectangular frame, whereas plate 8 rests on an internal transverse branch 18 of a second frame-shaped flux channelling piece 19 which is surrounded in parallel relation by the first one and which in its turn surrounds the carcase of the coil.

Figure 3:
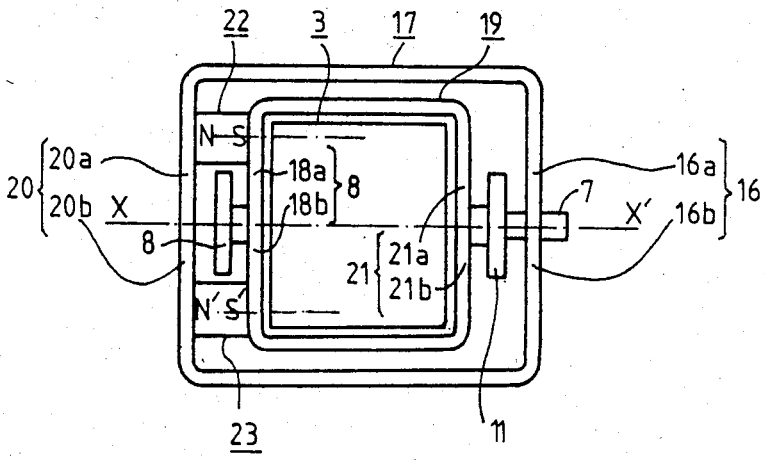
FIG. 3 shows an elevational view of the electromagnet of FIG. 1.

It can be seen in the Figure that another external branch 20 is placed opposite the internal branch 18 of frame 19 and that another internal branch 21 of this frame is placed opposite external branches 20 16, so that each plate is placed between two parallel branches. These branches form pairs of transverse pole extensions 20*a*, 20*b*, respectively 16*a*, 16*b* and 18*a*, 18*b* respectively 21*a*, 21*b* as is shown in FIG. 3.

It is evident that at least the internal branches, and respectively one external branch, comprise axial openings, not shown so as not to overload the Figure, for allowing the core, respectively extension 7, to pass therethrough.

Two parallel magnets 22 and 23 are placed symmetrically with respect to the axis XX' between branches 20 and 18 so that their magnetic poles of the same sign are applied against the same branch and so that their NS, N'S' magnetization axes, which are both parallel to the axis, pass substantially through the carcase of the coil. This results in a reduction of the space required and a difference of iron which the flux of the magnet must travel through for flowing towards faces 18, 20 on the one hand and 16, 21 on the other.

The two internal branches have accordingly the same magnetic polarity, of a certain sign, whereas the two external branches in their turn have the same magnetic polarity of a sign opposite that of the preceding one.

It can be seen that the device which has just been described has two stable states, defined by the end positions of the core for which, in the absence of energization of the coil, the core may have passing therethrough two fluxes of opposite directions which are supplied by the permanent magnets and which are transmitted alternately by the flux channelling pieces. In the second stable state opposite that of FIG. 1, plate 8 passes between the magnets and is applied against branch 20 whereas plate 11 is applied against branch 21.

When a DC (or rectified) current of suitable direction is fed into the coil through its two terminals 24, 24' the control flux developed thereby will oppose the permanent flux passing through the core; if this control flux is of sufficient strength, the core will move axially so as to take up an opposite end position.

Figure 2:
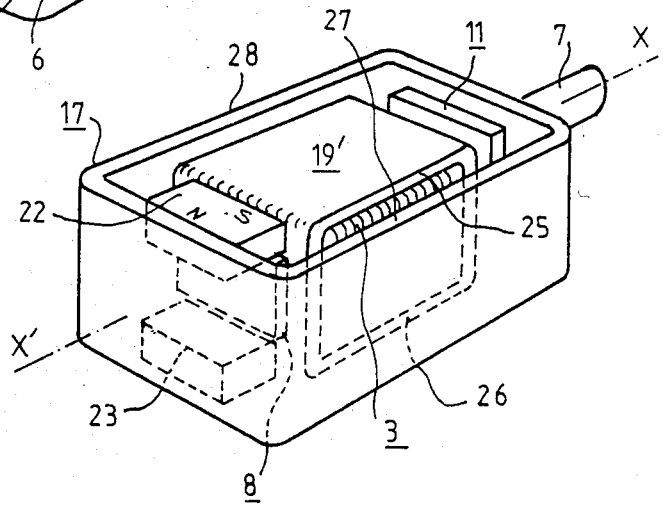

It is clear that an identical operation will be obtained if two other magnets, such as magnets 22, 23 are placed in a similar way between branches 16 and 21 so that their fluxes are additive; however, in this case the iron lengths to be travelled through are the same. It can also be seen that the operation remains the same if the flux channelling piece 19' is caused to pivot, for example, by a quarter of a revolution with respect to piece 17 around axis XX', as can be seen in FIG. 2.

It will also be readily understood that the permanent flux may again be channellized if one of the dividing walls 25 or 26, or 27 or 28 should be removed for particular reasons or reduced in section on condition that one of them is left for connecting together, in each frame, the lateral branches which form transverse extensions required for establishing a flux through the widened pole portions of the plates and then of the core.

Figure 4:
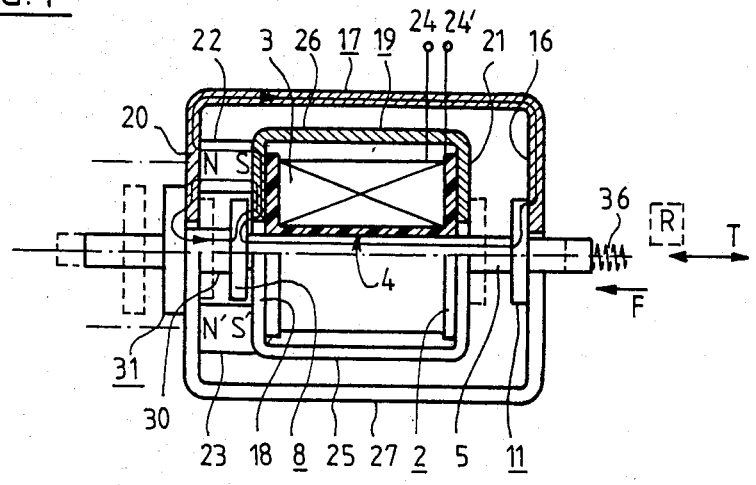
FIG. 4 illustrates, in an elevational sectional half view, an electromagnet having the general construction shown in FIG. 1, but in which particular first measures have been taken for conferring thereon a monostable character.

In the embodiment illustrated in FIG. 4, where the parts having the same function bear the same references, an extension 30 of the core comprises a third plate 31, external to frame 17, which is moved away from branch 20 for a rest position R in which the core is moved leftwards and which is applied thereagainst for the opposite working end position T shown in this Figure, whereas plate 8 does not reach branch 18. It is clear that, for this latter position, a low reluctance magnetic circuit (comprising branch 18, plate 8, extension 30, plate 31 and branch 20) will be placed in parallel with a circuit comprising branch 18, core 5, plate 11 and the external dividing walls 27, 28 of the flux channelling piece 17 and will thus shunt the flux developed by the permanent magnets so that the attraction forces exerted on the plates for this position will no longer have the same intensity if saturation phenomena appear for example in branch 18. Consequently, on the disappearance in the coil of the energization current which is required for bringing the plates into this position T, attractions of opposite directions may be exerted without any remanence effect between the plates and branches 20, respectively, 21, for bringing the mobile armature formed by the assembly of pieces 5, 8 and 11 back to the rest position R.

The operation of this electromagnet has then a monostable characteristic which may be advantageously used for controlling the apparatus of the relay or contactor type.

Figure 5:
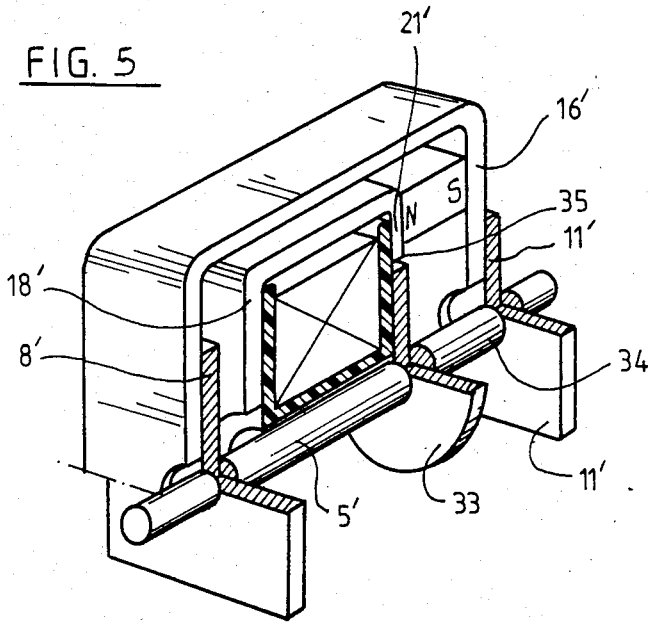
FIG. 5 shows in a perspective view with a quarter cut away, an electromagnet having a construction close to that shown in FIG. 1. but in which second particular measures have been taken for conferrring thereon a monostable character.

In a monostable electromagnet variant shown in FIG. 5, a small parallel reluctance could also be provided by a third plate 33, placed on an extension 34 of core 5' situated between branches 16', and 21' so as to come into position in the plane of branch 21' through a slightly larger opening 35 thereof, whereas plate 11' is positioned externally to branch 16'. This variant however causes transverse attraction forces to appear on plate 33.

In the other position, the magnetic circuit is closed because of the contact of plates 8', 33 against the branches 18' respectively 16'.

Finally, an assistance spring such as 36 may also be adjoined to the core for providing an axial force F capable of improving the monostable character of the device.

Figure 6:
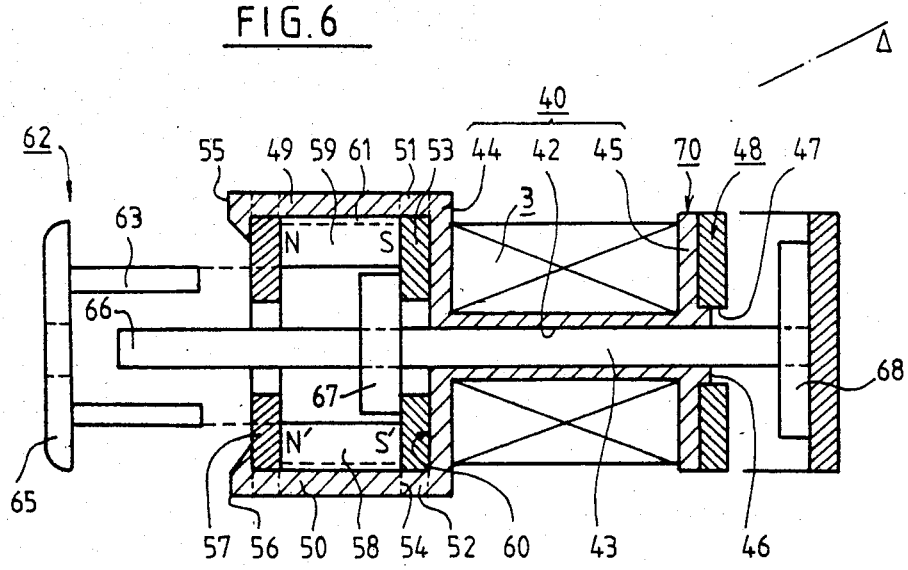
FIGS. 6, 7 and 8 show, in an elevational view in section through an axial plane, a side view and a half sectional top view, an electromagnet in which means for assembling its different parts are described.
Figure 7:
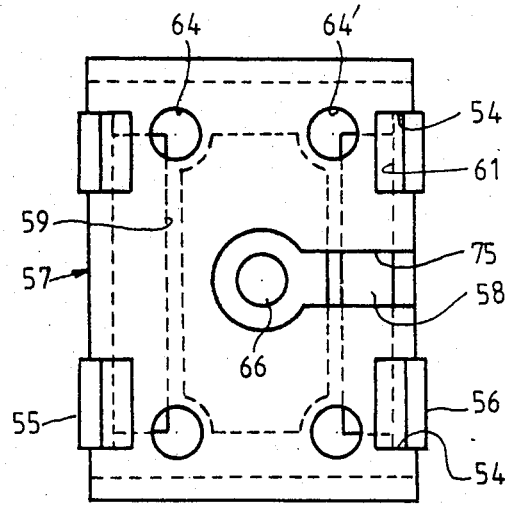
Figure 8:
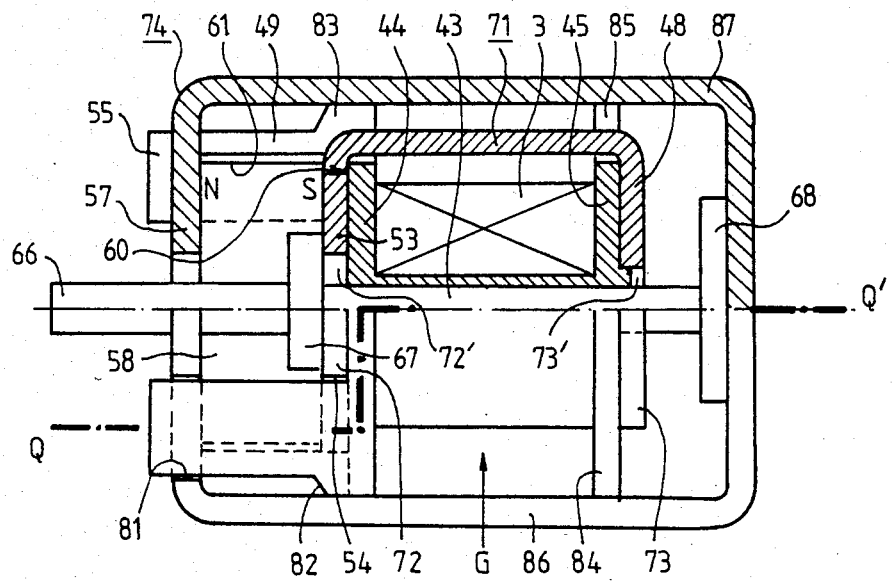

One embodiment of the electromagnet in accordance with the invention which is shown in FIGS. 6, 7 and 8 and the construction of which may be extended to any one of the embodiments presented, has been more especially adapted to that of FIG. 1.

This example uses particularly a synthetic molded piece 70 playing the role of the carcase of the coil and procuring association means adapted for firmly applying the pole faces of the permanent magnets against the branches of the flux conducting pieces.

The carcase 40 of coil 3 has a bore 42 whose ends are machined for guiding core 43, and two transverse cheeks 44, 45. One of these cheeks 45 may comprise a projection of small height 46 for centering same in an opening 47 in the internal flux guiding piece 48, whereas the generally rectangular cheek 44 has at each of its four apices a resilient longitudinal column of which two 49, 50 are shown in FIG. 6.

These columns which surround at their base 51, 52 the internal branch 53 and which may be centered with respect thereto by means of notches such as 54, see also FIG. 7, have at their respective ends a hook such as 55 or 56 which extends beyond the external flux guiding branch 57.

The permanent magnets 58, 59 which are placed between these parallel branches are held in firm contact therewith through a longitudinal force developed by the columns between the hooks and the external surface 60 of cheek 44; these same columns, with limit a radial centrifugal movement of the magnets, may comprise housing portions such as 61 for providing lateral guiding of the magnets, see also FIG. 8.

Complementary holding of the magnets for preventing movement thereof towards the central axis as well as for providing angular guiding of the position of plates 67, 68 may be provided by an auxiliary guide piece 62, see FIG. 6, which comes in position on one or other of branches 57 or 53 and has small columns or walls parallel to the axis such as those shown at 63 in FIG. 6. In the embodiment, shown, in which piece 62 is firmly secured to branch 57, these small columns, which pass through openings 64, 64' in the external branch 57, see FIG. 7, form part of the same plate 65 pierced with an opening for allowing the passage therethrough of an extension 66 of the core provided for transmitting the movements.

If this extension is coupled to a contact holder whose movements are guided angularly and if branches 53, 57 comprise, opposite the pole surfaces of the magnets, flat depressions preventing movement thereof towards the axis, the auxiliary piece 62 may be omitted. In FIGS. 6 to 8, the proportions of the travel of the plates with respect to the other dimensions have not been respected, so as not to overload the drawing and so as to better show the structural details.

The electromagnet described is mounted in the following way:

- piece 70 is first of all provided with its core and its plates, these being for example rivetted or force fitted on the core;
- the coil carcase is then filled with wire, then its ends are connected to the terminals provided for this purpose; during this operation, piece 70 is held in the winding machine advantageously by means of hooks 55, 57;
- piece 70 is then introduced laterally into the internal flux guiding piece 71 and on side G where one of the longitudinal walls is missing; this introduction is facilitated for example by means of indentations 72, 73 formed in the internal branches, in the extension of the passage openings 72', 73' through which the core 43 passes;
- the assembly of piece 70 and piece 71 is then fitted cross wise, see direction Δ in FIG. 6, towards the external branch 57 of the flux guide piece 71 and is provided with its magnets; such fitting may be facilitated by a lateral indentation 75 in branch 57 ensuring an easier passage for extension 66, see FIG. 7;
- after the two pieces 74 and 71 have been coaxially aligned, this latter is pushed axially so that hooks 55, 57 are coupled with the edges of the external branch 57;
- piece 62 is positioned as required.

Figure 9:
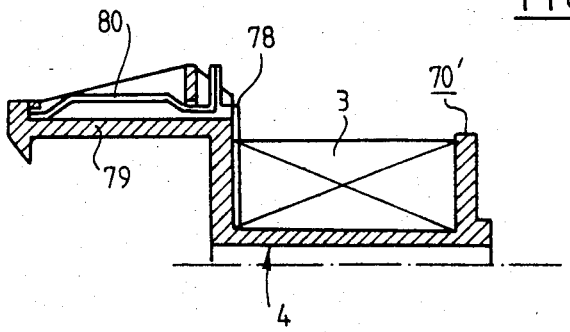
FIG. 9 shows, in an elevational half view, a molded piece serving as carcase for the coil, as support for its terminals and as assembly means with the fixed magnetic circuit.

The means for connecting the ends 78 of the wire of coil 3, see FIG. 9, may be advantageously fixed to two of the columns such as 79 belonging to the molded piece 70', in the form of tags to be soldered, screw terminals, or rigid or flexible metal zones 80 adapted for providing an electric connection by pressure and/sliding; FIG. 9 shows this latter solution; if required, terminals may be placed at the ends of the hooks which do not come into contact with the external branch.

Lateral holding of piece 71 inside piece 74, which may be provided by the cooperation of the columns and of the hooks with indentations 54 and 81 belonging respectively to these two pieces, may be completed by the contact of bosses of piece 70 such as 82, 83, 84, 85 with the longitudinal dividing walls 86, 87 of piece 74, see FIG. 8.

What is claimed is:

1. In a polarized electromagnet comprising:

a coil adapted to be supplied with DC current;

a magnetizable core which is movable between two longitudinal end positions occupied alternately by sliding inside the carcase of this coil and which has two opposite widened pole portions extending transversely with respect to the axis of the coil;

a fixed yoke having axially, on each side of each widened pole portion, a pair of pole extensions having opposite magnetic polarities which are conferred thereon by permanent magnetic means placed therebetween and orientated so that their magnetic axes are parallel to said axis; said widened pole portions cooperating with said extensions so that, for each of the two end positions, the magnetic flux sent by these magnetic means through the core is of reverse direction, two pairs of extensions, of the same first magnetic sign, placed symmetrically with respect to said axis of the coil form part of a first rectangular flux channelling piece surrounding a second flux channelling piece, which connects together two other pairs of symmetrical extensions having signs opposite to the first one and which surround a coil whose carcase is substantially traversed by the magnetic axes of permanent magnets disposed between transverse flux channelling branches.

2. The polarized electromagnet as claimed in claim 1, wherein said first flux channelling piece and said second flux channelling piece are in the form of two rectangular frames which are placed one in the other and have passing concentrically therethrough the coil and respectively an external extension thereof.

3. The electromagnet as claimed in claim 1, wherein an extension of the core comprises a third transverse plate which establishes with an external branch of the external flux channelling piece, and for one of the positions of the core, a small reluctance so as to divert a fraction of the flux supplied by the permanent magnets.

4. The electromagnet as claimed in claim 3, wherein said third plate rests on the outside of the external branch with which it cooperates, for each of the two end positions of the core.

5. The electromagnet as claimed in claim 3, wherein said third plate is placed in the plane of the internal branch with which it cooperates through the presence of a calibrated opening therein, and for one of the end positions of the core.

6. The electromagnet as claimed in claim 2, wherein said two frames are placed in the same plane.

7. The electromagnet as claimed in claim 2, wherein said two frames are respectively placed in two planes which are perpendicular.

8. The electromagnet as claimed in claim 2, wherein one of said rectangular frames is without one of its longitudinal dividing walls.

9. The electromagnet as claimed in claim 1, wherein a molded piece comprising a flat portion perpendicular to said axis and columns parallel thereto having hooks applies two transverse branches of said flux channelling pieces against the pole faces of the magnets and establishes a coaxial alignment of these two pieces.

10. The electromagnet as claimed in claim 1, wherein a molded piece which has lateral retaining means for the magnets and which at the same time effects an angular orientation of the plates and of the core is fixed to one of said flux channelling pieces.

11. The electromagnet as claimed in claim 9, characterized in that said molded piece also carries the carcase of the coil.

12. The electromagnet as claimed in claim 9, wherein two of the columns of the molded piece serve for maintaining in position connecting members connected to the ends of the wire of the coil.

13. The electromagnet as claimed in claim 10 characterized in that said molded piece also carries the carcase of the coil.

* * * * *